US005893291A

United States Patent [19]

Salazar

[11] Patent Number: 5,893,291

[45] Date of Patent: Apr. 13, 1999

[54] CRIMPING TOOL

[76] Inventor: Javier Salazar, 510 Abe St., Joliet, Ill. 60432

[21] Appl. No.: 09/138,333

[22] Filed: Aug. 21, 1998

[51] Int. Cl.[6] ..... B21D 11/00

[52] U.S. Cl. ..... 72/460; 72/459

[58] Field of Search ..... 72/457, 458, 459, 72/460, 470; 81/169, 110

[56] References Cited

U.S. PATENT DOCUMENTS

| | | | |
|---|---|---|---|
| 1,737,084 | 11/1929 | Hilstad | 72/479 |
| 1,886,732 | 11/1932 | Poland | 81/169 |
| 2,516,279 | 7/1950 | Waldie | 72/479 |
| 2,749,795 | 6/1956 | Boykin, Jr. | 72/479 |
| 2,776,587 | 1/1957 | Killius | 72/479 |
| 3,908,438 | 9/1975 | Norden | 72/479 |
| 4,392,264 | 7/1983 | Booe, Jr. | 81/169 |

*Primary Examiner*—David Jones
*Attorney, Agent, or Firm*—Ernest Kettelson

[57] ABSTRACT

A crimping tool for nut locks which comprise a ring type lock member having spaced apart teeth extending outwardly from the circumference and which are positioned adjacent a nut that is to be locked or held in place thereby when a selected one of the teeth is crimped or bent over to bear against the flat surface of the adjacent nut. The present invention comprises a flat support bar for placing over and across the outer end of the nut and member on which it is threaded, a puller member extends through an aperture at one end of the bar having a lateral projection or hook formed at its inwardly extending end with a puller nut threaded on the outwardly extending end of the puller member on the opposite side of the bar. The lateral projection or hook is positioned behind one of the teeth of the nut lock ring and the puller nut is then rotated to draw the tooth of the nut lock ring forward to crimp or bend over the surface of the adjacent nut. A slidably adjustable clamping lug is provided at the other end of the bar to clamp against an available housing portion when the puller is in position to engage and pull on a selected one of the teeth of the nut lock ring, thereby clamping and holding the bar in position while the puller crimps and bends the engaged tooth over one of the flat surfaces of the nut.

6 Claims, 5 Drawing Sheets

CRIMPING TOOL

FIELD OF THE INVENTION

A crimping tool for the nut lock used on rear dual wheel trucks. Such nut locks comprise a ring type lock member having spaced apart teeth extending outwardly from the circumference. A selected one of the teeth is crimped or bent over to bear against the flat surface of the adjacent axle nut holding the wheel on the axle, to prevent the nut from rotation and coming loose. The present invention comprises a threaded puller member on a support bar held in place over the axle nut and its adjacent lock nut ring member by an adjustable clamp. The puller member engages the selected lock nut tooth and bends it over the axle nut as the puller nut is rotated in the direction to draw the tooth engaged end of the puller in the "bend-over" or crimping direction.

BACKGROUND OF THE INVENTION

The most commonly used prior art method of crimping the teeth of the nut lock ring on the axle nut to keep it from turning and becoming loose is a pry bar or crow bar. However, the space within the hub cavity of the wheel in which to get at and behind the teeth of the nut lock ring is so small it is difficult to get the tip of the pry bar in place behind a selected one of the teeth. The puller of the present invention solves that problem.

The present invention comprises a flat support bar for placing over the outer end of the axle across the face of the axle nut, a puller member extends through an aperture at one end of the bar having a lateral projection or hook formed at its inwardly extending end on the inwardly facing side of the support bar with a puller nut threaded on the outwardly extending end of the puller on the oppositely facing side of the bar. The lateral projection or hook is positioned behind one of the teeth of the axle nut lock ring and the puller nut is then rotated to draw the tooth of the nut lock ring forward to crimp or bend over the surface of the adjacent axle nut. A slidably adjustable clamping lug is provided at the other end of the bar to clamp against a portion of the wheel hub when the puller is in position to engage and pull on a selected one of the teeth of the axle nut lock ring, thereby clamping and holding the bar in position while the puller crimps and bends the engaged tooth over one of the flat surfaces of the axle nut.

Other prior art devices for crimping teeth of a lock member over on to an adjacent nut known to the inventor include those disclosed in U.S. Pat. Nos. 4,392,264; 1,886,732; 1,480,811; and 212,659 which are readily available to the public and interested parties in the United States Patent and Trademark Office as well as in the public libraries of various cities throughout the United States.

SUMMARY OF THE INVENTION

The crimping tool in accordance with the present invention comprises an elongated support bar having a puller receiving aperture at one end and an elongated clamp adjusting slot at the other end. A puller member extends through the puller receiving aperture, such puller member having a hook at its end extending from the inwardly facing surface of the support bar and threads on its end extending from the outwardly facing surface of such bar to receive a puller nut thereon. A clamping member extends through the adjusting slot, comprising a lug member having a threaded bore extending from the inwardly facing surface of the support bar in which the threaded shank of a tightening screw is received from the outwardly facing surface of the support bar against which the head of the tightening screw bears when the screw is tightened.

To use the crimping tool for crimping the teeth of a lock nut ring over the axle nut in place on a threaded axle or shaft, the support bar is placed against the outer end of the axle or shaft extending across its diameter to position the puller member in alignment with a selected one of the teeth of the lock nut ring to be crimped over the axle nut and to position the clamping lug in position to bear against an available bearing surface diametrically across from the selected lock nut tooth to be crimped. The tightening screw of the clamping member is loosened to slide the lug of the clamping member against the bearing surface whereupon it is tightened to hold the lug securely in place in clamping engagement against the bearing surface when the hook of the puller member has been positioned behind the selected lock nut tooth. The puller nut is then tightened to draw the hook against the lock nut tooth thereby bending over and crimping against the facing surface of the axle nut. The axle nut is thereby locked in place and cannot be loosened or rotated until the crimped lock nut tooth is bent back out of contact with the surface of the axle nut.

DESCRIPTION OF THE PREFERRED EMBODIMENT

Figure 1:
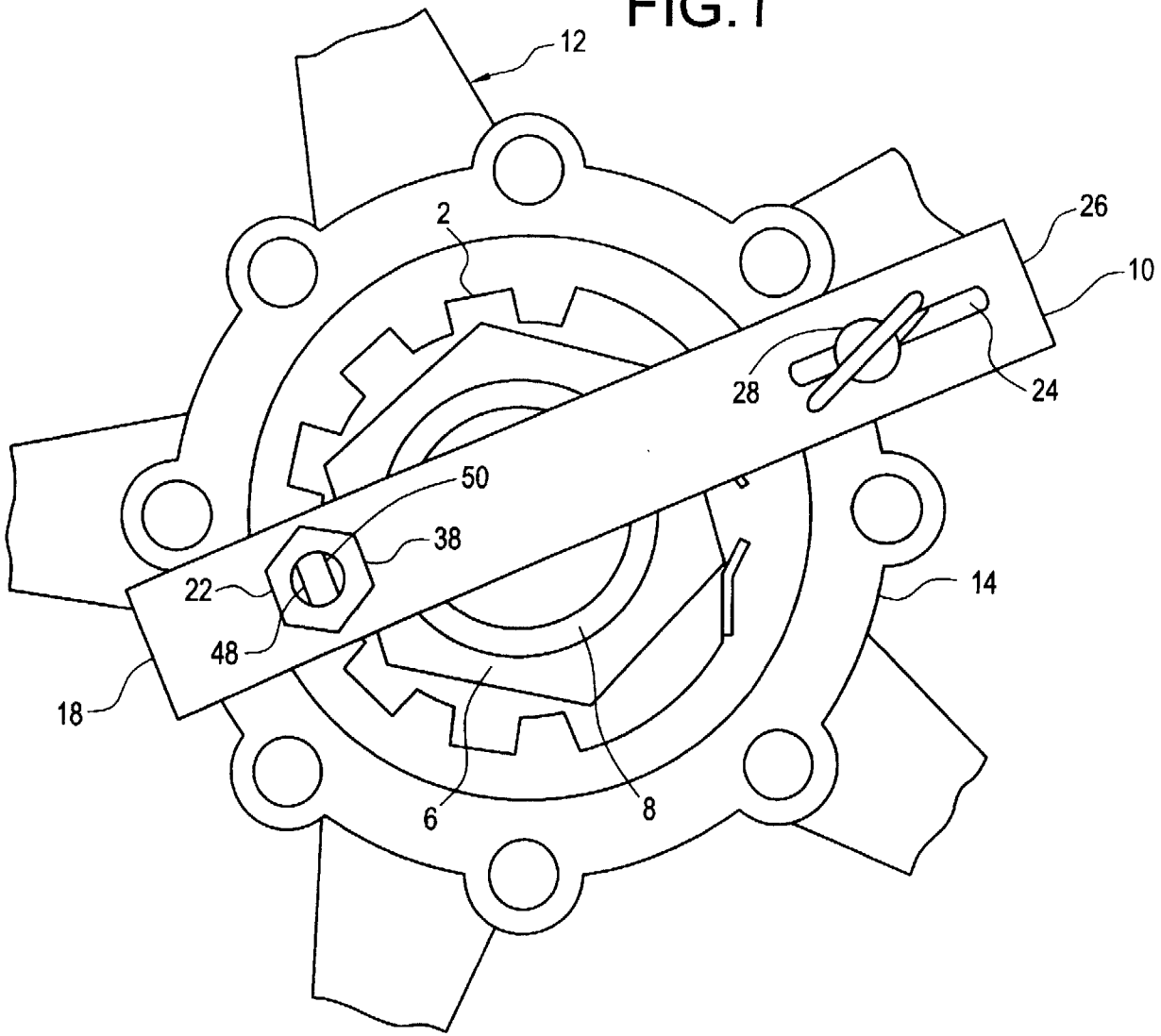
FIG. 1 is a side elevation view of a portion of the outside rear wheel of a dual rear wheel truck, having the hub cap removed to expose the outer end of the axle to view, with an axle nut thereon and a toothed lock nut ring member behind and adjacent to the axle nut, showing a crimping tool in accordance with this invention in place to crimp one of the teeth of the lock nut ring member over the axle nut to thereby hold it in place and against rotation relative to the axle on which it is threaded.
Figure 2:
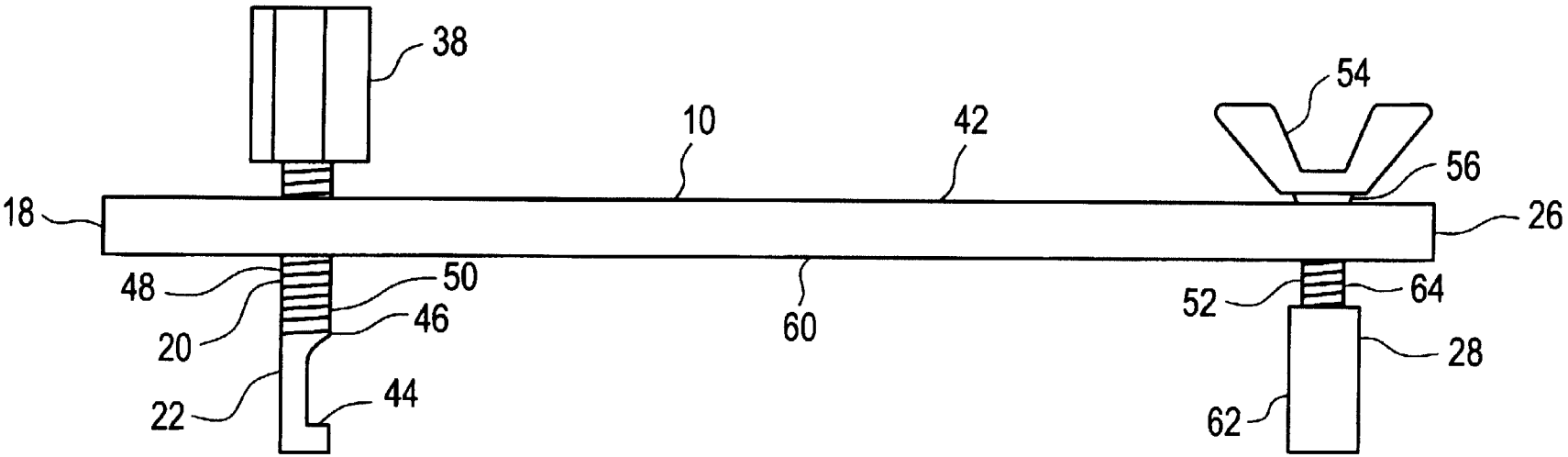
FIG. 2 is a side elevation view of the crimping tool with the puller member and crimping member in place on the support bar.
Figure 3:
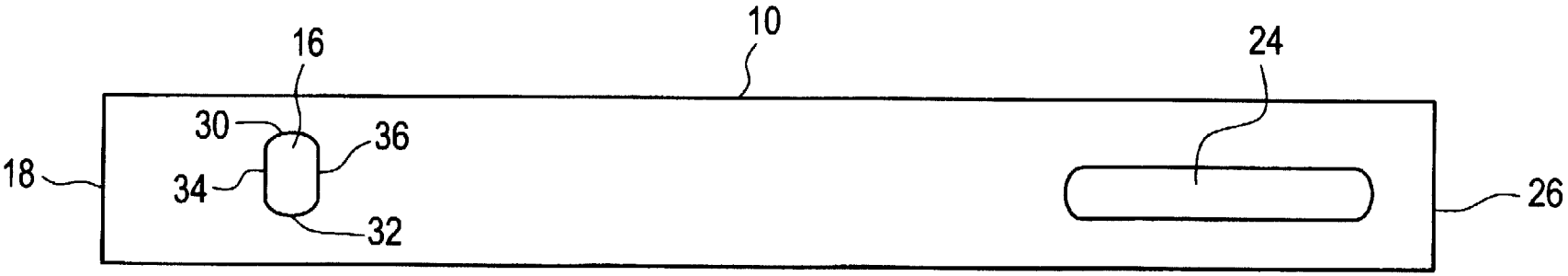
FIG. 3 is a plan view of the support bar of the crimping tool shown without the puller member and crimping member thereon.
Figure 4:
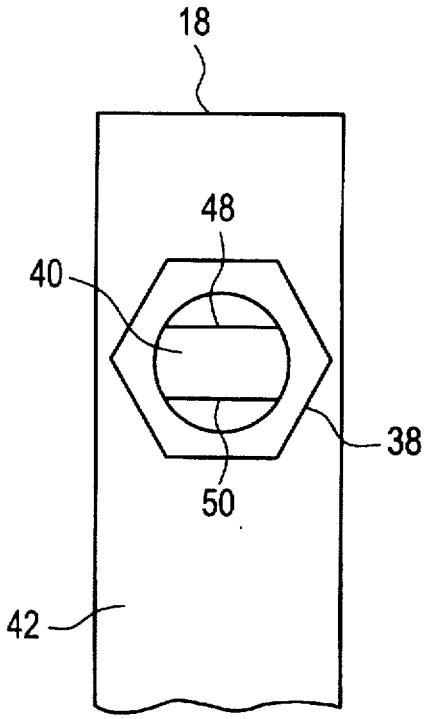
FIG. 4 is a plan view of a portion of the upwardly facing surface of the support bar and the upper end of the puller member having the puller nut threaded thereon.
Figure 5:
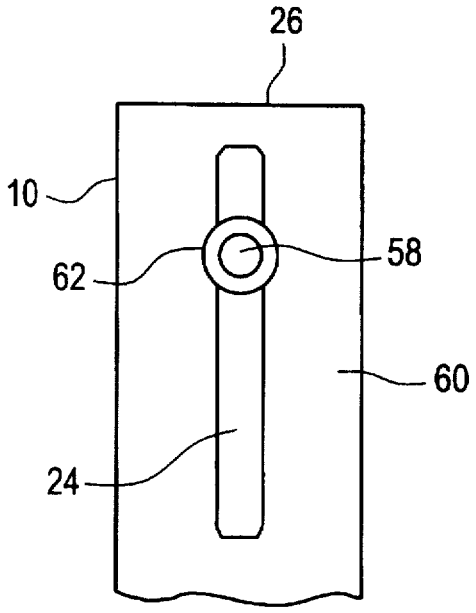
FIG. 5 is a plan view of a portion of the downwardly facing surface of the support bar and the lower end of the clamping member having the cylindrical lug threaded thereon.
Figure 6:
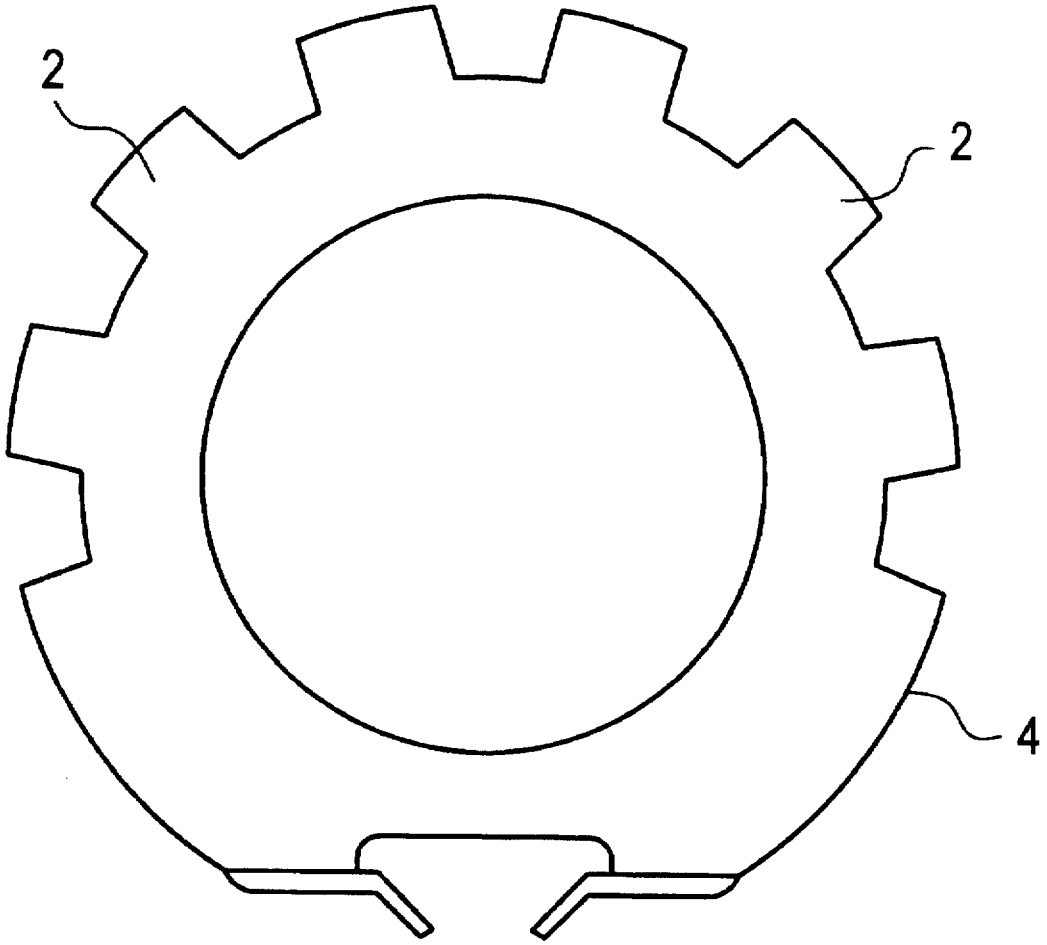
FIG. 6 is a plan view of a toothed lock nut ring member of the kind used to lock and secure the axle nut of a dual rear wheel truck assembly in place on the rear axle.
Figure 7:
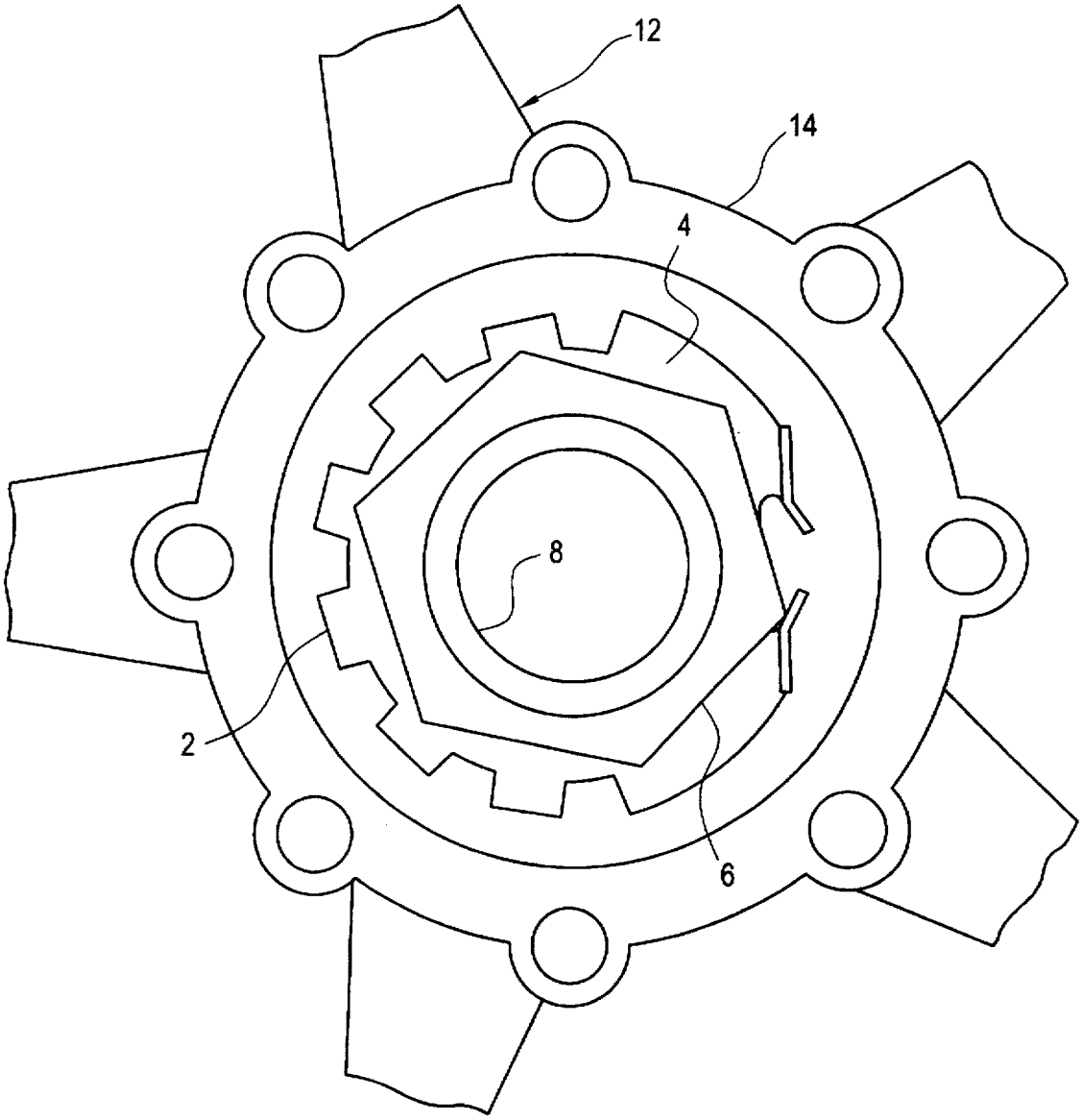
FIG. 7 is a side elevation view of the portion of the outside rear wheel of a dual rear wheel truck assembly as shown in FIG. 1 but without the crimping tool in place to show the position of the toothed lock nut ring member behind and adjacent to the axle nut before the crimping tool bends and crimps one of the teeth over the axle nut.

A crimping tool in accordance with the present invention is provided primarily for crimping a selected one of the teeth 2 of a lock nut ring member 4 over and against an adjacent axle nut 6 on the rear axle 8 of dual wheel trucks. The crimping tool includes an elongated support bar 10 about six to ten inches in length depending on the size of the truck's wheels 12, hubs 14, axles 8 and axle nuts 6. The invention can be used for other applications in which a toothed lock nut ring member is adjacent to a nut that is to be locked in place and prevented from rotation by crimping one of the teeth of the lock nut ring member over the adjacent nut.

The support bar 10 has a puller member aperture 16 near one end 18 to receive the threaded shank 20 of a puller member 22 therethrough. An elongated adjusting slot 24 extends through a portion of the support bar near its opposite end 26 to receive an adjustable clamping member 28 therethrough.

The puller member aperture 16 has two diametrically opposite arcuate side walls 30 and 32 and two diametrically opposite flat side walls 34 and 36. The puller member 22 comprises a threaded shank 20 about four to five inches long having a puller nut 38 threaded on its outwardly extending threaded end 40 extending from the outwardly facing surface 42 of the support bar 10. A hook member 44 is integrally formed at the opposite end 46 of the puller member 22. The shank 20 of the puller member is preferably threaded from its outer end 40 to the juncture point 46 where it is integrally connected to the hook member 44. The diameter of the shank 20 corresponds to that of the puller member aperture 16 for a relatively close fit of the shank 20 as it extends therethrough. A portion of the shank 20 which extends outwardly from the juncture point 46 has a pair of diametrically opposed flat sides 48 and 50,spaced apart a distance corresponding to the spaced apart distance of the diametrically opposed flat side walls 34 and 36 of the puller member aperture 16. Thus, when the shank 20 of the puller member 22 extends through the aperture 16, the flat sides 48 and 50 closely face the corresponding flat side walls 34 and 36, respectively, of the puller member aperture 16 for bearing engagement thereagainst to prevent rotation of the shank 20 when received through the aperture 16.

The elongated adjusting slot 24 near the opposite end 26 of the support bar 10 extends longitudinally of the support bar about two to three inches and has a width of about a quarter of an inch to three eighths of an inch. An adjustable clamping member 28 is received therethrough for sliding movement along the slot 24 to what ever position necessary to clamp against a bearing portion of the wheel hub 14 that is diametrically opposite from the tooth 2 of the lock nut ring member 4 that the puller member 22 is to engage for crimping over the axle nut 6.

The clamping member 28 holds the support bar 10 in such diametrically opposite position and prevents it from rotating or skewing out of such position when the nut 38 of the puller member 22 is rotated to bend the tooth 2 of the lock nut ring member 4 against the axle nut 6.

The clamping member 28 comprises a threaded bolt 52 about in inch in length having a wing nut head 54 integrally formed thereon at its outwardly facing end 56 which extends from the outwardly facing surface 42 of the support bar 10. The opposite inwardly extending end 58 of the clamping member bolt 52 extends from the inwardly facing surface 60 of the support bar 10. A cylindrical lug 62 having an internally threaded bore is threaded on to the threaded shank 64 of the clamping member bolt 52 from its inwardly extending end 58. After the hook member 44 of the puller member 22 is placed in engagement behind the selected tooth 2 of the lock nut ring member 4 that is to be crimped over the axle nut 6, and the support bar 10 is positioned across and outwardly of the axle nut 6, axle 8 and hub 14 of the truck wheel 12 to place the clamping member 28 diametrically across from the puller member 22, with the inwardly facing surface 60 of the support bar 10 bearing against the outer end of the hub 14, the clamping member 28 is then slidingly moved in the adjusting slot 24 until the cylindrical lug 62 contacts and bears against a portion of the hub 14. The threaded clamping member bolt 52 is then rotated in the direction which draws the internally threaded cylindrical lug tightly against the inwardly facing surface 60 of the support bar 10 to hold it in place in the adjusting slot 24 and to thereby hold the crimping tool clamped in position.

With the hook member 44 of the puller member 22 in position behind the selected tooth 2 of the lock nut ring member 4 to be crimped over the axle nut 6, the puller nut 38 on the puller member 22 is then rotated in the direction which draws the hook member toward the inwardly facing surface 60 of the support bar 10 which in turn bends the selected tooth 2 over the surface of the axle nut 6 thereby locking it in place.

The portion of the support bar 10 inward from its end 18 is drawn toward and bears against the facing surface of the hub 14 as can be seen in FIG. 1, when the nut 38 is tightened to bend or crimp the lock nut tooth 2 over the axle nut 6.

I claim:

1. A crimping tool for bending a selected tooth of a lock nut ring member having a plurality of radially spaced apart teeth around its circumference and for crimping said tooth against the surface of an adjacent nut to hold it against rotation, said crimping tool comprising a support member having an outwardly facing surface on one side and an inwardly facing surface on the opposite side, a puller member having engagement means to engage a said selected tooth of a said lock nut ring member and draw said selected tooth toward said inwardly facing surface of said support member, said puller member having operating means to draw said engagement means and a said selected tooth of said lock nut member toward said support member, and said crimping tool having holding means for holding said support member in position for operation of said operating means and said engagement means and against movement of said support member during said operation thereof, wherein said puller member includes an elongated shank extending inwardly from said inwardly facing surface of said support member and terminating at an inwardly extending end, said engagement means comprising a projection extending laterally from said elongated shank adjacent said inwardly extending end, wherein said support member includes a puller member aperture, said elongated shank of said puller member extending through said puller member aperture and a portion of said shank extending outwardly from said outwardly facing surface of said support member terminating in an outer free end, said puller member aperture having a flat side wall, said elongated shank of said puller member having a flat portion facing said flat side wall of said puller member aperture when received therethrough for bearing engagement thereagainst to hold said shank against rotation relative to said puller member aperture.

2. A crimping tool for bending a selected tooth of a lock nut ring member having a plurality of radially spaced apart teeth around its circumference and for crimping said tooth against the surface of an adjacent nut to hold it against rotation as set forth in claim 1, wherein said operating means of said puller member includes threads around a threaded portion of said shank extending from said outer free end and inwardly thereof, a puller member nut having internal threads threadedly engaged on said threaded portion of said elongated shank facing said outwardly facing surface of said support member and positioned for bearing engagement thereagainst during operation of said operating means.

3. A crimping tool for bending a selected tooth of a lock nut ring member having a plurality of radially spaced apart teeth around its circumference and for crimping said tooth against the surface of an adjacent nut to hold it against rotation, said crimping tool comprising a support member having an outwardly facing surface on one side and an inwardly facing surface on the opposite side, a puller member having engagement means to engage a said selected tooth of a said lock nut ring member and draw said selected tooth toward said inwardly facing surface of said support member, said puller member having operating means to draw said engagement means and a said selected tooth of said lock nut member toward said support member, and said crimping tool having holding means for holding said support member in position for operation of said operating means and said engagement means and against movement of said support member during said operation thereof, wherein said holding means includes a clamp member to hold said support member against rotation, wherein said support member includes adjustable receiving means to receive and support said clamp member thereon.

4. A crimping tool for bending a selected tooth of a lock nut ring member having a plurality of radially spaced apart teeth around its circumference and for crimping said tooth against the surface of an adjacent nut to hold it against rotation as set forth in claim 8, wherein said adjustable receiving means of said support member includes an elongated adjusting slot extending through said support member from its said outwardly facing surface to said inwardly facing surface thereof and extending longitudinally of said support member on a line through the center of said puller member aperture, said elongated adjusting slot being spaced apart from said puller member aperture, said clamping member being received through said adjusting slot and securable at any selected position in said slot to define a clamping space between said clamping member and said puller member spaced apart therefrom.

5. A crimping tool for bending a selected tooth of a lock nut ring member having a plurality of radially spaced apart teeth around its circumference and for crimping said tooth against the surface of an adjacent nut to hold it against rotation as set forth in claim 4, wherein said clamping member comprises a bolt having a bolt head at an outer end thereof on said side of said support member having said outwardly facing surface thereon and a threaded shank extending inwardly thereof to terminate at a free end on the opposite side of said support member, a cylindrical lug having an internally threaded bore being threadedly received on said threaded shank of said clamping member from said free end thereof to face and bear against said inwardly facing surface of said support member when said bolt comprising said clamping member is rotated in the tightening direction to draw said cylindrical lug tightly thereagainst to thereby hold said clamping member in a selected position in said elongated adjusting slot.

6. A crimping tool for bending a selected tooth of a lock nut ring member having a plurality of radially spaced apart teeth around its circumference and for crimping said tooth against the surface of an adjacent nut to hold it against rotation as set forth in claim 5, wherein said bolt head of said clamping member comprises a hand grasp member whereby said bolt comprising said clamping member can be rotated and tightened by hand.

* * * * *